United States Patent [19]

Wilson et al.

[11] Patent Number: 4,671,284

[45] Date of Patent: Jun. 9, 1987

[54] SAUNA SUPPORT BED

[75] Inventors: Jimmy L. Wilson; Gordon V. Lieffring, both of Prairie Village, Kans.

[73] Assignee: Vibrosaun USA, Inc., Minneapolis, Minn.

[21] Appl. No.: 892,487

[22] Filed: Aug. 1, 1986

[51] Int. Cl.[4] ..... A61H 33/06

[52] U.S. Cl. ..... 128/373; 4/530; 5/60; 119/39; 128/1 B; 269/322

[58] Field of Search ..... 128/1 B, 400, 372, 373; 119/35, 37, 39; 5/60, 61, 62; 269/322; 4/529, 530

[56] References Cited

U.S. PATENT DOCUMENTS

| | | | |
|---|---|---|---|
| 668,661 | 2/1901 | Schneider | 4/529 |
| 1,643,399 | 6/1925 | Wentworth . | |
| 1,797,153 | 3/1931 | Nogradi . | |
| 1,947,007 | 2/1934 | Hoffman | 128/1 B |
| 2,096,128 | 10/1937 | Mortrude, Jr. . | |
| 2,235,184 | 3/1941 | Wettlaufer . | |
| 2,289,881 | 7/1942 | Mallory . | |
| 2,479,030 | 8/1949 | Taggart | 119/39 |
| 2,500,508 | 3/1950 | Bachin . | |
| 2,676,596 | 4/1954 | Rouat | 128/373 |
| 2,764,959 | 10/1956 | Church | 119/39 |
| 2,814,297 | 11/1957 | Stewart . | |
| 2,908,271 | 10/1959 | Ware . | |
| 3,470,866 | 10/1969 | Gittelson | 128/1 B |
| 3,782,362 | 1/1974 | Puzio | 128/1 B |
| 3,826,250 | 7/1974 | Adams . | |
| 4,321,913 | 3/1982 | Maluta | 128/1 B |
| 4,430,992 | 2/1984 | Christ . | |
| 4,565,188 | 1/1986 | Hardie . | |
| 4,617,912 | 10/1986 | Beer | 128/1 B |

FOREIGN PATENT DOCUMENTS

| | | | |
|---|---|---|---|
| 888367 | 9/1943 | France | 128/1 B |
| 182398 | 1/1963 | Sweden | 128/1 B |

*Primary Examiner*—Clyde I. Coughenour

*Attorney, Agent, or Firm*—Schmidt, Johnson, Hovey & Williams

[57] ABSTRACT

A personal sauna has a horizontally extending bed for supporting an individual in a recumbent position, and combines the benefits of heat and vibration by means of a transversely recirculating air system and a motive means which simultaneously moves the bed with both relatively fast vibrations and relatively slow, longitudinally oscillating rocking motions. The air recirculation system comprises a chamber extending longitudinally beneath the bed supporting the individual, and two elongated heating elements disposed below opposite side regions of the bed heat air which is then directed upwardly to a compartment surrounding the body at substantially equal airflow rates along the entire length of the bed. Transverse airflow through the compartment minimizes the face velocity of the flowing air, and thereby reduces the likelihood of drafts while substantially eliminating the occurrence of localized relatively hot regions within the compartment. A headrest, stationary relative to the osciallating bed, supports the head exteriorly of the compartment and introduction of fresh air into a region surrounded by U-shaped walls provides an air curtain for minimizing the escape of heated air from the compartment, while supplying a sufficient quantity of fresh, cool air for breathing purposes.

4 Claims, 6 Drawing Figures

Fig.1.
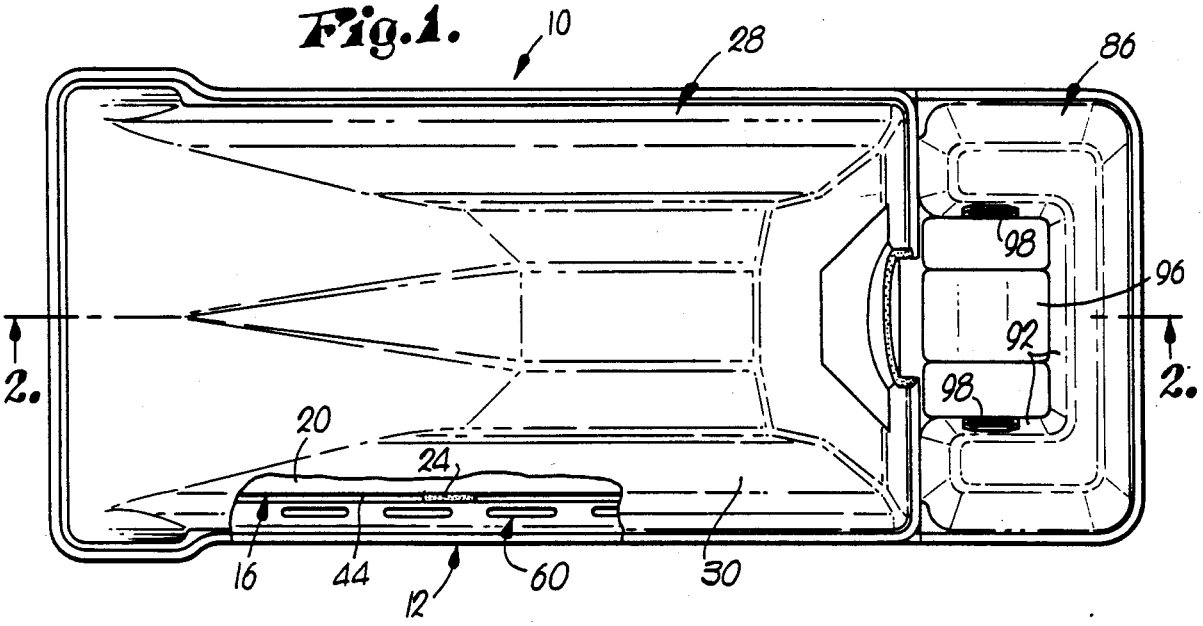
Fig.2.
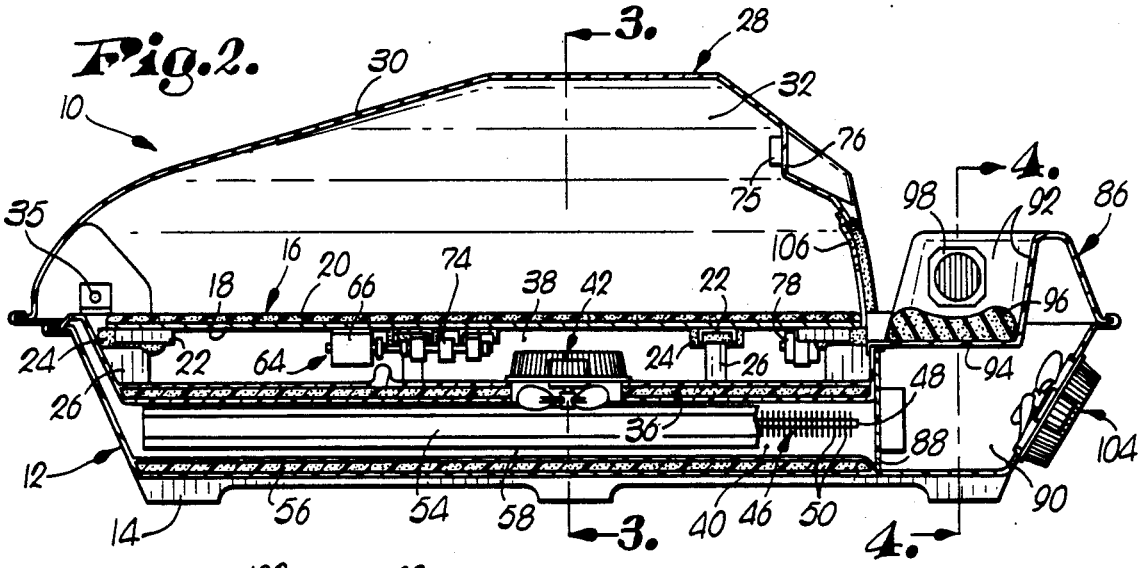
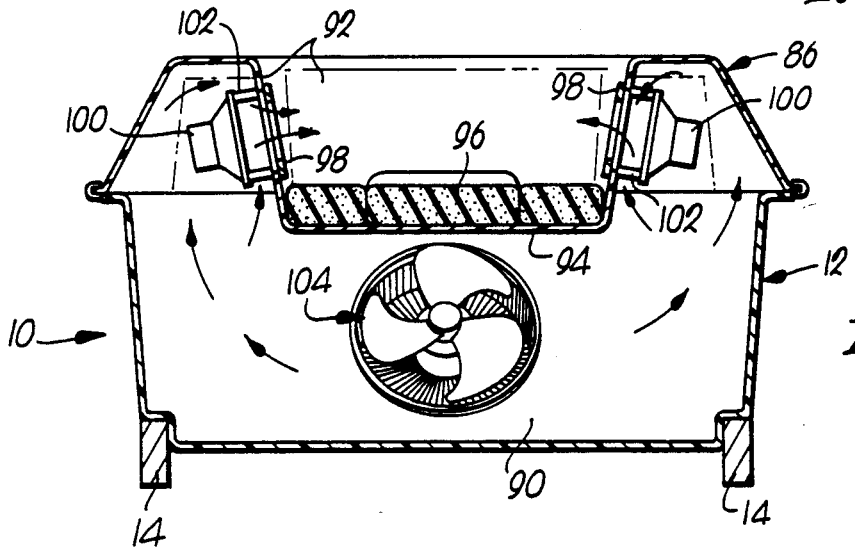
Fig.4.

Fig.3.
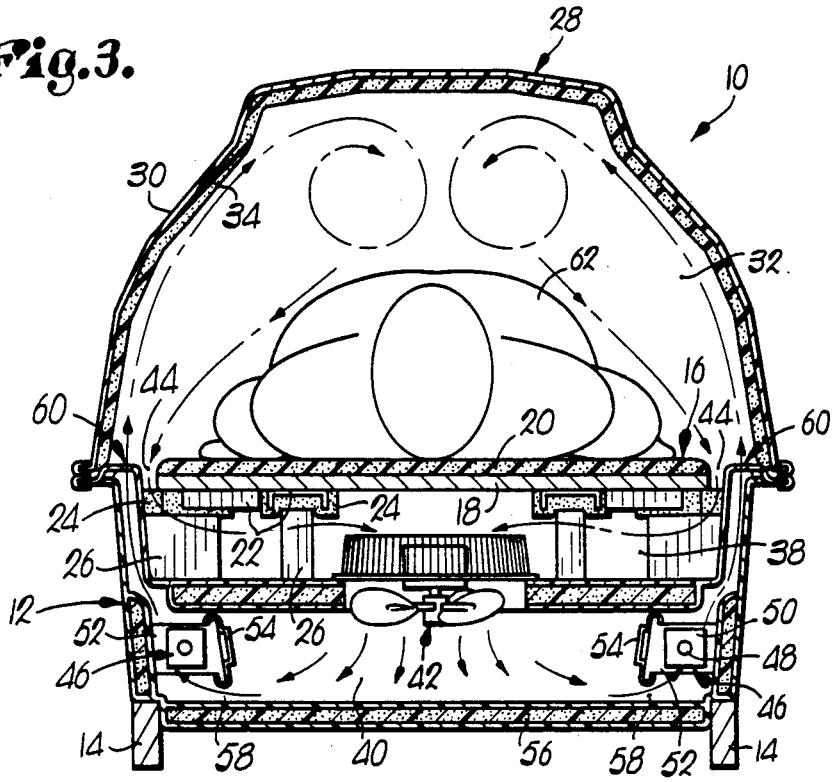
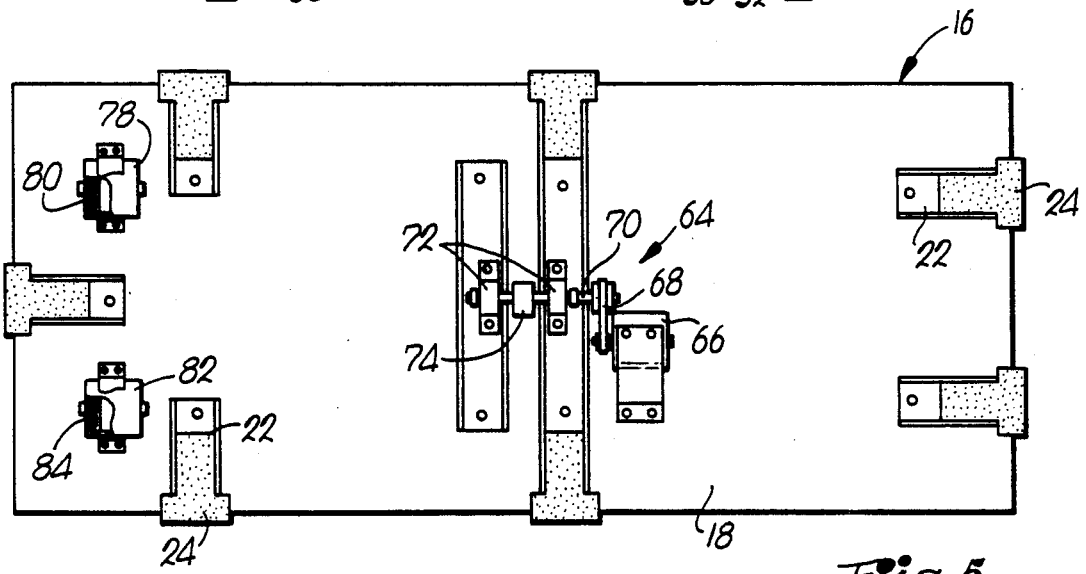
Fig.5.
Fig.6.
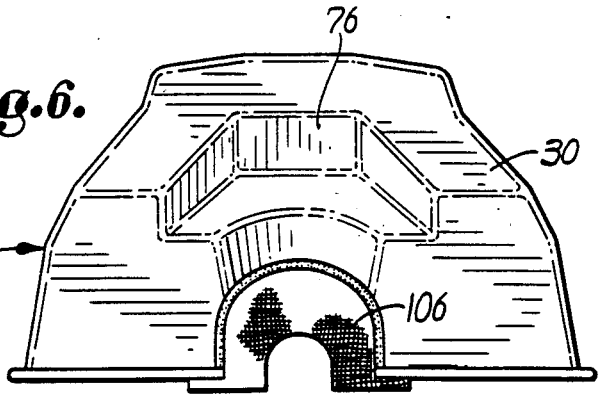

SAUNA SUPPORT BED

BACKGROUND OF THE INVENTION

1. Field of the Invention

This invention relates to a personal enclosure for administering heat, vibration and stereo music to an individual lying atop a horizontally extending bed resiliently mounted on a base within a closed compartment, and wherein three spaced vibratory motors coupled to the underside of the bed transmit both relatively fast, vibratory oscillations as well as a relatively slow, fluctuating, longitudinally rocking movement to the bed. A recirculating air system within the sauna includes a pressurized chamber extending longitudinally beneath the bed along the entire length thereof, and two spaced, elongated heating elements extend longitudinally along opposite sides of the chamber and communicate with respective elongated air outlets disposed on opposite side regions of the bed, to enable uniform transverse distribution of air heated by the elements to all portions of the individual's body with a minimum air face velocity. Fresh, cool air from a cavity below a headrest and separate from the compartment and chamber is directed by a fan toward the occupant's head.

2. Description of the Prior Art

Vibration and heat have long been in widespread use for their therapeutic values. Blood flow is increased to areas stimulated by vibration, which in turn induces relaxation and facilitates transport of waste materials. Muscles that are not utilized in daily life remain healthy and supple with the utilization of vibration therapy.

Heating the skin to induce sweating is known to enlarge pores of the skin and allow waste products to leave the body. In addition to cleansing the outer skin layers, heat also increases blood flow by dilating blood vessels, and increased circulation of blood accelerates blood flow to internal organs, thereby assisting in processing and transporting waste materials. Beautiful skin and a healthy, toned body are common results to the dry heat provided by a sauna.

In the past, a number of devices have attempted to maximize the vibratory sensation experienced by an individual lying on a horizontally extending bed. U.S. Pat. Nos. 1,643,399, 2,235,184, 2,500,508 and 4,565,188 disclose therapeutic tables or beds that include a motor and a vibratory member eccentrically coupled to the motor for rotational movement in a reference plane, but the variety of reference planes of movement as set forth by these various references suggest that an entirely satisfactory vibrational motion has not been yet defined.

U.S. Pat. Nos. 2,908,271 and 4,430,992 set forth therapeutic tables wherein a plurality of motors and vibratory members eccentrically coupled to respective motors provides vibratory oscillation in intersecting reference planes; however, it is believed that the complex, multi-directional motion provided at relatively high speed by the vibratory mechanisms of these patents does little to enhance relaxation of the individual while simultaneously stimulating by vibration the various regions of the body.

Also, it is known that other prior art devices have provided structure for warming individuals, by means of both cabinets which enclose the body below the head region as well as therapeutic tables which are open to the atmosphere. An example of the latter is disclosed in U.S. Pat. No. 2,500,508, wherein separate compartments below leg regions and upper torso regions of the bed each contain heaters, and wherein air from a relatively small, circular inlet rises by natural convection through each of the compartments and exits from elongated slots extending through the bed surface. Unfortunately, the movement of air through the compartments of the table shown in U.S. Pat. No. 2,500,508 is uneven, unpredictable and causes "hot spots", and no means is provided for recirculating the air and warming the skin areas of the body not in direct adjacent relationship to the air outlets on the table surface.

U.S. Pat. Nos. 2,096,128 and 3,826,250 illustrate heated cabinets or enclosures for surrounding a patient, but heat is transferred to the patient by a conduction process that is relatively slow and uneven.

Other arrangements for heating an individual within an enclosed cabinet are shown in U.S. Pat. Nos. 2,814,297 and 4,565,188, wherein a fan directs air through a relatively small, circular heating element, and air is discharged adjacent the foot regions of the individual, circulated longitudinally along the body, and then returned to the fan after passing adjacent the shoulder regions of the individual. However, the arrangements shown in U.S. Pat. Nos. 2,814,297 and 4,565,188 are somewhat unsatisfactory since the feet are exposed to the highest temperatures, causing discomfort, and since the heat inlets and outlets in the cavity are relatively small, requiring that the face velocity of the recirculating air be relatively high, thereby promoting drafts, uneven heat distribution, and discomfort in general to the individual.

As a consequence, it would be a desirable advance in the art if means were provided for increasing the comfort of an individual lying within an enclosed compartment or sauna, by means of both improving the heat distribution from a heat source to the individual's body as well as by enhancing the sensory experience which occurs as a result of vibrating, oscillatory movements that are transmitted to the bed supporting the body.

SUMMARY OF THE INVENTION

The present invention overcomes the above noted disadvantages of prior art therapeutic vibrating beds and tables by provision of a motive means for inducing a relatively slow, longitudinally oscillating, rocking motion in a patient-supporting, horizontally extending bed while causing the latter to simultaneously vibrate at relatively fast speeds. As a result, an individual lying atop the bed experiences front-to-back and side-to-side "waves" of motion during the time that relatively small and fast oscillatory vibrations are transmitted to the body.

In more detail, the oscillatory motive means comprises a first motor and vibratory member eccentrically coupled to the first motor for movement in a substantially vertical reference plane transverse to the longitudinal axis of the bed, as well as two other motors and vibratory members eccentrically coupled thereto for movement in a common second plane parallel to the aforementioned vertical reference plane and horizontally spaced therefrom in a direction along the length of the bed. A means for causing the first motor to rotate at a speed different from the speed of the second and third motors enables the vibratory members to rock the bed longitudinally in vertical and horizontal directions as the three vibratory members steadily alternate between synchronous time periods of movement in parallel directions and time periods of movement in non-parallel directions at a frequency which is less than the speed of rotation of any of the motors. At the same time, relatively fast vibratory oscillations of movement of the bed in planes transverse to the longitudinal axis of the bed are experienced by the individual during the relatively slow, longitudinally rocking movement, enabling the individual to fully relax and experience a unique, beneficial sensation.

The invention also concerns a novel means for uniformly directing heated, recirculating air to all portions of the individual's body with a minimum of localized hot regions and/or drafts. Air is recirculated through the sauna compartment in a direction transverse to the longitudinal axis of the bed, enabling a generally uniform airflow rate along the length of the body without excessive face velocities.

The heating and recirculating air system of the present invention includes an elongated chamber beneath the bed and extending along the entire length thereof, with a blower for introducing recirculated air into the chamber. A pair of elongated heating elements disposed in spaced, parallel relationship to each other in the chamber below opposite side regions of the chamber receive air from one of two elongated air inlets associated with each heating element, and air heated by the elements is directed through outlet slots which extend along the entire length of side regions of the bed for distributing air evenly to the compartment in transverse relationship thereto. The air inlets as well as the air outlets are of substantially equal length to the chamber and the bed, enabling the air to be uniformly heated by the elements and discharged to the sauna compartment with a minimum face velocity.

Another aspect of the invention is directed toward a novel U-shaped structure for supporting the head of the individual exteriorly of the compartment enclosing the remaining areas of the body. The head supporting structure has U-shaped walls for surrounding the sides of the head, and speakers placed on opposed walls in positions adjacent the ears are spaced slightly from the walls to enable air from a second blower to be discharged through speaker grilles so that the head continuously receives a supply of fresh air for breathing. Introduction of positive air pressure into the U-shaped head supporting structure also balances the air pressure within the sauna compartment, creating an "air curtain" which minimizes escape of heated air from the compartment in regions adjacent the neck area of the individual.

BRIEF DESCRIPTION OF THE DRAWINGS

FIG. 1 is a top plan view of the sauna of the present invention with parts broken away in section to reveal longitudinally extending air outlets and air intake ports for recirculation of air within a compartment of the sauna;

FIG. 2 is a side cross sectional view of the sauna taken along line 2—2 of FIG. 1, revealing the sauna compartment, a longitudinally extending heating chamber below a bed in the compartment, as well as a cavity beneath the head region of the sauna separated from the chamber by a bulkhead;

FIG. 3 is an enlarged, end cross sectional view taken along line 3—3 of FIG. 2, and illustrating the pattern of air circulation within the sauna compartment, an intake plenum, and the chamber;

FIG. 4 is an enlarged end cross sectional view of the sauna taken along line 4—4 of FIG. 2, depicting the cavity within the head region of the sauna and the pattern of air circulation therein;

FIG. 5 is an enlarged bottom view of the sauna bed shown in FIG. 2, illustrating the motive means for inducing both relatively slow as well as relatively fast oscillations in the resiliently mounted bed; and FIG. 6 is an end cross sectional view of a pivotal top of the sauna of FIG. 2 taken in a direction looking toward the foot region of the sauna at a position between the sauna walls defining the bodily compartment and the sauna walls defining the head supporting structure.

DETAILED DESCRIPTION OF THE DRAWINGS

A therapeutic apparatus or personal sauna is broadly designated by the numeral 10 and is depicted in FIGS. 1–6. The sauna 10 has a base 12 molded of a fiberglass resinous material with two spaced, parallel wooden legs 14 having channels for engagement with forks of a forklift when transport of the sauna 10 is desired.

An elongated, horizontally extending bed 16 includes a relatively rigid panel 18 covered by resilient padding 20 that is best shown in FIGS. 2 and 3. Seven U-shaped, inverted channels 22 are secured to the underside of the panel 18 (in this regard, see FIG. 5), and the channels 22 have a configuration for graspingly engaging respective T-shaped supports 24 that in turn rest on corresponding, upright blocks 26 (FIGS. 2 and 3) fixed to the base 12. The supports 24 are formed of a resilient, synthetic resinous foam material for resiliently mounting the bed 16 to the base 12 for movement of the bed 16 relative to the base 12 in horizontal as well as vertical directions.

Preferably, each of the T-shaped blocks 26 includes a relatively thin, square, plywood stiffener (not shown) that is placed between two horizontally extending layers of material forming the block 26. The upper layer of the block 26 may be molded from a material having a different degree of resiliency, or spring constant, than the material comprising the lower layer of the block 26, in order to facilitate movement of the bed 16 relative to the base 12 while providing a requisite amount of strength.

The sauna 10 includes a top 28 having relatively rigid walls 30 preferably molded from a synthetic resinous material and which define a compartment 32 (FIGS. 2 and 3) for enclosing the major portion of an individual 62 lying on the bed 16 with the exception of the individual's head. A thermally insulative, resilient liner 34 is secured to walls 30, and the top 28 is pivotally coupled to base 12 by a pair of pivots 35, one of which is shown in FIG. 2. As such, top 28 is swingable about a horizontal axis relative to base 12 to allow ingress or egress of an individual to and from the compartment 32.

An elongated, flat divider 36 partitions the area within sauna 10 below bed 16 into an elongated intake plenum 38 above divider 36 and an elongated supply chamber 40 below divider 36. Both the plenum 38 and the chamber 40 extend horizontally the entire length of bed 16, and a fan or blower 42 directs air from plenum 38 toward chamber 40. Air from compartment 32 is admitted into the plenum 38 by elongated intake ports 44 (FIGS. 1 and 3) that are formed in the space between side regions of the bed 16 and an upper, interior wall portion of the base 12. The intake ports 44 extend completely along the side regions of the bed 16 except for the regions occupied by supports 24.

A pair of elongated, electric resistance heating elements 46 are disposed in spaced, parallel relationship to each other in the chamber 40 below opposite side regions of bed 16. Each of the heating elements 46 extends substantially along the entire length of the chamber 40 and thereby is substantially equal in length to the length of bed 16. Referring to FIGS. 2 and 3, the heating elements 46 have a round, central shaft 48 containing an electric resistance wire for generating heat, and the elements 46 also include a series of flat, upright, square heat conduction fins 50 that are horizontally spaced along the length of shaft 48. Brackets 52 connected to shaft 48 secure the heating elements 46 to a lower wall of base 12 within chamber 40, as is illustrated in FIG. 3.

An elongated, horizontally extending cover 54 is fixed to the brackets 52 of each heating element 46 in spaced relationship to the overlying divider 36 and an underlying bottom 56 of based 12. Consequently, the space between each cover 54 and the bottom 56 defines a pair of elongated air inlets 58 which extend along the entire length of each respective heating element 46 for distributing air from the blower 42 evenly to the heat conduction fins 50 in longitudinally transverse relationship to the horizontally extending shaft 48. A small portion of air from the blower 42 is also directed to the space above the cover 54 to thereby impede overheating of divider 36 by each of the heating elements 46.

As shown in FIGS. 1 and 3, a pair of elongated air outlets 60 are parallel to the longitudinal axis of shaft 48 and air inlets 58 and are oppositely disposed adjacent side regions of bed 16. Each of the air outlets 60 comprises a series of slots (see FIG. 1) and is associated with one of the heating elements 46 and communicates the compartment 32 with chamber 40. Each of the air outlets 60 extends along the entire length of the bed 16 for distributing air from the chamber 40 and heated by the elements 46 to the compartment 32 and thereby to an individual's body lying atop the bed 16.

Recirculation of air throughout the sauna 10 during operating of the blower 42 is depicted by the arrows in FIG. 3, where it can be seen that air discharged by blower 42 moves about the heating elements 46 and is discharged through air outlets 60 in a generally vertical direction along the liner 34 of top 28. When the air reaches the upper regions of compartment 32, the air moves in a swirling pattern as depicted in the vicinity of upwardly facing bodily surfaces of individual 62 lying within compartment 32. Thereafter, air descends around the sides of the individual 62 and opposed side regions of the bed 16, and is then drawn through intake ports 44 and into the plenum 38 by suction forces generated by blower 42.

As can now be appreciated, the configuration of chamber 40, air inlets 58, heating elements 46 and air outlets 60 enable the blower 42 to evenly distribute air throughout the length of blower 42 and thereafter direct the air evenly in a transverse relationship across each of the heating elements 46. The pressure of air is instantaneously equalized in all regions of chamber 40 before passage through air inlets 58, so that a substantially even airflow rate through inlets 58 and corresponding outlets 60 is effected along the entire length of bed 16. As a result, all portions of the individual's body 62 below the head and neck regions receive an equal flow of air and an equal quantity of thermal energy from heating elements 46. At the same time, flow of air transversely to the longitudinal axis of bed 16 enables the face velocity of the air to be retained at a minimum, so that drafts and the like are avoided. Moreover, the extended length of each heating element 46 permits the latter to operate at lower, safer temperatures, further promoting even heat distribution while decreasing the possibility of failure due to thermal stress.

A motive means 64 for generating motion in bed 16 comprises a first means including a first motor 66 which drives a belt 68 that rotates a shaft 70 supported by pillow blocks 72. A first weighted, vibratory member 74 is eccentrically mounted on the shaft 70 for rotation therewith and for circular movement in a vertical reference plane transverse to the longitudinal axis of bed 16. The speed of the first motor 66 can be selectively increased or decreased by means of a variable speed control 75 mounted on a panel 76 (FIGS. 2 and 6) of top 28.

The motive means 64 also includes a second means comprising a second motor 78 connected to bed 16 and a second vibratory member 80 eccentrically coupled to motor 78. As shown in FIG. 5, motive means 64 also includes a third motor 82 connected to a region of bed 16 opposite second motor 78 and a third vibratory member 84 is eccentrically connected to third motor 82 for rotational movement therewith. Both of the vibratory members 80, 84 rotate in circles that lie in a common vertical plane which is substantially parallel to the aforementioned vertical reference plane in which vibratory member 74 rotates and is horizontally spaced from the vertical reference plane in a direction along the length of bed 16. Preferably, vibratory members 80, 84 are positioned immediately below opposite shoulder regions or shoulder blades of the individual 62 lying atop bed 16, while the first vibratory member 74 is located immediately below the hip region of the body of individual 62.

The control 75 comprises a means for causing the first motor 66 to rotate at a speed different from the speed of the second motor 78 and the third motor 82 and thereby cause the first vibratory member 74 to rotate at a velocity different than the rotational velocities of the second and third vibratory members 80, 84. The difference in speed between the motor 66 and the motors 78, 82 causes the bed 16 to rock longitudinally in vertical and horizontal directions as the first vibratory member 74 and the members 80, 84 steadily alternate between synchronous time periods of movement in parallel directions and time periods of movement in non-parallel directions. That is, rotation of the member 74 at a speed different than the member 80, 84 will cause the member 74 to exert a thrust on the bed 16 which is in alignment with the thrust produced by members 80, 84 when the latter are in the same rotative position as the member 74. During such periods of alignment, bed 16 will be shifted in a direction parallel to this thrust. However, immediately thereafter, the difference in speed between member 74 and members 80, 84 will change the alignment of the latter relative to member 74, so that a common thrusting effort is not again produced until member 74 again rotates to a position realigned with members 80, 84.

As such, the difference in speed between the first motor 66 and the motors 78, 82 will slowly rock the bed 16 at a frequency which is substantially less than vibratory oscillations which are transmitted to bed 16 by members 74, 80, 84 during each rotation thereof. The longitudinal, relatively slow rocking motion is experienced by the individual 62 in both horizontal and vertical directions, since members 74, 80 and 84 rotate in vertical, parallel planes. The sensation that is experienced by the individual 62 lying atop bed 16 can be described as a relatively slow "wave" of movement and results in a pleasurable feeling when combined with the relatively fast vibratory oscillations transmitted to the bed 16 during each rotation of members 74, 80 and 84.

Provision of selective adjustment of the rotational speed of first motor 66 by control 75 enables the individual 62 to adjust the frequency of oscillation of the relatively slow, rocking movements of bed 16. Though the exact kinetics of the motive means 64 are not fully understood, it is believed that the speed of first motor 66 can be adjusted by control 75 until the relatively slow, rocking movements of the bed 16 are maximized, perhaps due to a balancing of the weight of individual 62 against the spring constant of the resilient supports 24. In any case, control 75 permits each user to adjust the frequency of the rocking motion until the pleasure experienced thereby is maximized The sauna 10 also includes a headrest 86 that is fixed to base 12 for supporting the head of individual 62 in a fixed position while the remaining regions of the body are carried by the shiftable bed 16. As shown in FIG. 2, the headrest 86 includes a bulkhead 88, thereby defining a cavity 90 within headrest 86 separate from chamber 40 and plenum 38. Advantageously, electronic components for the sauna 10 may be carried by the bulkhead 88 within cavity 90, out of contact with the relatively warm air within compartment 32, plenum 38 and chamber 40.

Referring to FIGS. 1, 2 and 4, the headrest 86 includes upright, somewhat inclined walls 92 forming a generally U-shaped configuration for surrounding the head of individual 62. Plate 94, along with a reversible cushion 96, provide support for the head of individual 62 at an elevation in a general alignment with height of the top of bed 16. The walls 92 extend to a height approximately equal to the front of the face of individual 62 when the latter is lying in a face up orientation.

Two speaker grilles 98 are carried on opposed, upright portions of the U-shaped walls 92, and each of the grilles 98 is positioned to be in direct adjacent relationship to the ears of individual 62. A pair of speakers 100 are fixedly mounted to spacers 102 which in turn are secured to walls 92 within cavity 90, so that speakers 100 are maintained in spaced relationship to walls 92. A fan 104 connected to headrest 86 draws air from outside the sauna 10 and into the cavity 90, and thereafter air is discharged around speakers 100 and through grilles 98, as indicated schematically by the arrows in FIG. 4.

The configuration of the U-shaped walls 92, in cooperation with the air discharged through grilles 98 by fan 104, maintains a positive air pressure in the space adjacent the head of the individual 62 and provides an "air curtain" to generally preclude heated air from discharging from the compartment 32 and around a curtain 106 (FIGS. 2 and 6) which is connected to top 28 to partially cover an opening formed in the latter and through which the neck of individual 62 extends. Positive air pressure in the exterior region of the U-shaped walls 92 adjacent the individual's head increases efficiency of the sauna 10 by reducing the amount of heated air that would otherwise escape from the compartment 32.

Introduction of fresh air through grilles 98 by fan 104 also functions to provide a continuous supply of air to the head of individual 62, for cooling the latter and enabling breathing of air which is not circulating within compartment 32. Of course, speakers 100 also provide stereo music for listening, to further enhance the pleasurable experience during use of sauna 10.

Finally, it is to be noted that the slope of the top 28 in the vicinity of panel 76 is such as to enable the individual 62 to see directly ahead when lying on bed 16 and headrest 86. As can be understood by reference to FIGS. 1, 2 and 6, the inclined nature of the top 28 adjacent panel 76 reduces the likelihood that a person using sauna 10 would experience a claustrophobic feeling since the top 28 slopes away from the line of sight and downward vision of the individual 62 is not blocked.

From the foregoing, it is clear that the invention provides an especially effective sensory experience combining the effect of slowly moving, draft-free, equalized dry heat distribution along with oscillatory motion simultaneously at slow rocking speeds and fast vibration frequencies. It is recognized, however, that those skilled in the art may make various modifications or additions to the preferred embodiment chosen to illustrate the invention without departing from the gist and essence of our contribution to the art. Accordingly, it is to be understood that the protection sought and to be afforded hereby should be deemed to extend to the subject matter claimed and all equivalents thereof within the scope of the invention.

We claim:

1. In a sauna having walls defining a compartment and an elongated, horizontally extending bed connected to said walls and positioned at least partially within said compartment for supporting an individual in a recumbent position, said bed having longitudinally extending, opposed, side regions, means for uniformly directing heated, recirculating air to all portions of an individual's body lying atop said bed, said means comprising:

structure defining an elongated chamber beneath said bed and extending substantially along the entire length thereof;

blower means coupled to said structure for introducing recirculated air to said chamber;

heating element means having a longitudinal axis parallel with the longitudinal axis of the chamber and extending substantially the entire length of said chamber;

elongated air inlet means extending substantially the entire length of said heating element means and said chamber for distributing air from said blower means evenly to all regions along the length of said heating element means in longitudinally transverse relationship to the latter; and elongated air outlet means extending substantially along the entire length of said bed and communicating said heating element means with said compartment for distributing air from said chamber and heated by said elements to an individual's body lying atop said bed with a generally uniform airflow rate along the length of the body and without excessive air face velocities.

2. In a sauna having walls defining a compartment and an elongated, horizontally extending bed connected to said walls and positioned at least partially within said compartment for supporting on individual in a recumbent position, said bed having longitudinally extending, opposed, side regions, means for uniformly directing heated, recirculating air to all portions of an individual's body lying atop said bed, said means comprising:

structure defining an elongated chamber beneath said bed and extending substantially along the entire length thereof;

blower means coupled to said structure for introducing recirculated air to said chamber;

a pair of elongated heating elements disposed in spaced, parallel relationship to each other in said chamber below said opposite side regions of said bed, each of said elements extending substantially along the entire length of said bed;

a pair of elongated air inlets each extending substantially along the length of a respective one of said heating elements in longitudinally transverse relationship to the latter; and a pair of elongated air outlets parallel to said air inlets and oppositely disposed adjacent said side regions of said bed, each of said air outlets being associated with one of said heating elements and being in communication with said compartment, each of said air outlets extending substantially along the length of said bed for distributing air from said chamber and heated by said elements to an individual's body lying atop said bed with a generally uniform airflow rate along the length of the body and without excessive air face velocities.

3. The invention of claim 2, wherein said outlets are positioned to discharge air in said compartment in vertical directions, and said walls include wall portions defining elongated air intake parts disposed in side-by-side, parallel relationship to said air outlets, said air intake ports being in communication with said blower means.

4. The invention of claim 3, wherein said wall portions include intake ports extending substantially along the length of the side regions of said bed.

* * * * *